United States Patent [19]

Brooker et al.

[11] Patent Number: 4,831,346

[45] Date of Patent: May 16, 1989

[54] SEGMENTED COAXIAL TRANSMISSION LINE

[75] Inventors: Eric L. Brooker, Hinsdale; Sidney M. Bennett, Chicago, both of Ill.

[73] Assignee: Andrew Corporation, Orland Park, Ill.

[21] Appl. No.: 31,098

[22] Filed: Mar. 26, 1987

[51] Int. Cl.[4] ..... H01P 1/04; H01P 3/06

[52] U.S. Cl. ..... 333/260; 333/244

[58] Field of Search ..... 333/243, 244, 260; 174/28, 88 C

[56] References Cited

U.S. PATENT DOCUMENTS

| | | | |
|---|---|---|---|
| 2,437,482 | 3/1948 | Salisbury | 333/244 |
| 3,106,599 | 10/1963 | Leitner et al. | 333/260 X |
| 3,286,015 | 11/1966 | Hildebrand et al. | 333/244 X |
| 3,291,895 | 12/1966 | Van Dyke . | |
| 3,955,871 | 5/1976 | Kruger | 333/260 X |
| 4,046,451 | 9/1977 | Juds et al. . | |
| 4,096,350 | 6/1978 | Mayr et al. | 174/88 C |
| 4,176,244 | 11/1979 | Ramy et al. | 174/88 C |
| 4,543,548 | 9/1985 | Seal et al. . | |

FOREIGN PATENT DOCUMENTS

| | | | |
|---|---|---|---|
| 823403 | 11/1959 | United Kingdom | 333/260 |

OTHER PUBLICATIONS

Moreno, *Microwave Transmission Design Data*, Dover Publ., New York, 1948, title page and pp. 82, 83.

Catalog 32 "Antenna Systems", copyright 1983 by Andrew Corporation, pp. 60–68; 116–117; 124–135; and 158–162.

Andrew Bulletin 37458A—Installation Instructions for Type 79AZ Splice for Heliax Coaxial Cable; printed Sep. 1980.

Drawing for Splice Assembly 79AZ, from Andrew Corporation.

*Primary Examiner*—Paul Gensler

*Attorney, Agent, or Firm*—Stephen G. Rudisill

[57] ABSTRACT

A flexible coaxial cable assembly that can be efficiently packaged and shipped in segments and installed and assembled in the field. The cable includes strain insulators spaced along the length of the region between the inner and outer conductors to transmit stresses such as differential thermal expansion and contraction between the conductors. The inner conductors of successive cable segments may be rigidly joined to each other to prevent relative movement between the inner conductors of adjacent cable segments. The inner and outer conductors can be corrugated.

20 Claims, 4 Drawing Sheets

SEGMENTED COAXIAL TRANSMISSION LINE

FIELD OF THE INVENTION

The present invention relates generally to coaxial transmission lines, and primarily to coaxial cables which are somewhat flexible so that they can be used in installations which require the transmission line to bend.

SUMMARY OF THE INVENTION

It is a principal object of the present invention to provide an improved coaxial cable assembly in which at least the outer conductor is fabricated and shipped in relatively short lengths (e.g., thirty-nine feet) rather than long lengths wound on reels, but which functions like a continuous cable after it has been assembled and installed. In this connection, a related object of the invention is to provide such an improved coaxial assembly which permits semi-flexible coaxial cable to be efficiently packaged and shipped even when the cable has a relatively large cross section (e.g., 8 to 12-inch diameter).

It is a further object of this invention to provide an improved coaxial cable assembly of the foregoing type which permits the inner and outer conductors to be separately packaged and shipped.

Another important object of this invention is to provide an improved air dielectric coaxial cable which reduces deformation of the inner conductor due to differential thermal expansion and contraction between the inner and outer conductors or to movement of the cable supports.

It is a further object of this invention to provide such an improved coaxial cable which can be quickly and efficiently installed in the field.

Yet another object of the invention is to provide such an improved coaxial cable which does not allow relative movement between successive segments of the cable after it has been installed.

A still further object of the invention is to provide such an improved coaxial cable which permits the use of corrugations in only spaced regions along the length of the cable.

Still another object of this invention is to provide an improved coaxial cable which permits the corrugations to be more shallow than required when the cable is to be wound on a reel.

It is also an object of this invention to provide an improved air dielectric coaxial cable assembly which includes strain insulators spaced along the length of the region between the inner and outer conductors, and means for compensating for the adverse effect of such insulators on the VSWR of the cable assembly without any localized temperature increase at the insulator locations.

A further object of the invention is to provide a segmented coaxial cable assembly which permits precise longitudinal positioning of the inner and outer conductors during installation.

It is still another object of the invention to provide a segmented coaxial cable assembly which provides ready access to the joints between the inner conductor segments for repair or replacement purposes.

Other objects and advantages of the invention will be apparent from the following detailed description and the accompanying drawings.

DESCRIPTION OF THE PREFERRED EMBODIMENT

While the invention is susceptible to various modifications and alternative forms, a specific embodiment thereof has been shown by way of example from the drawings and will be described in detail. It should be understood, however, that it is not intended to limit the invention to the particular form described, but, on the contrary, the intention is to cover all modifications, equivalents, and alternatives falling within the spirit and scope of the invention defined by the appended claims.

Figure 1:
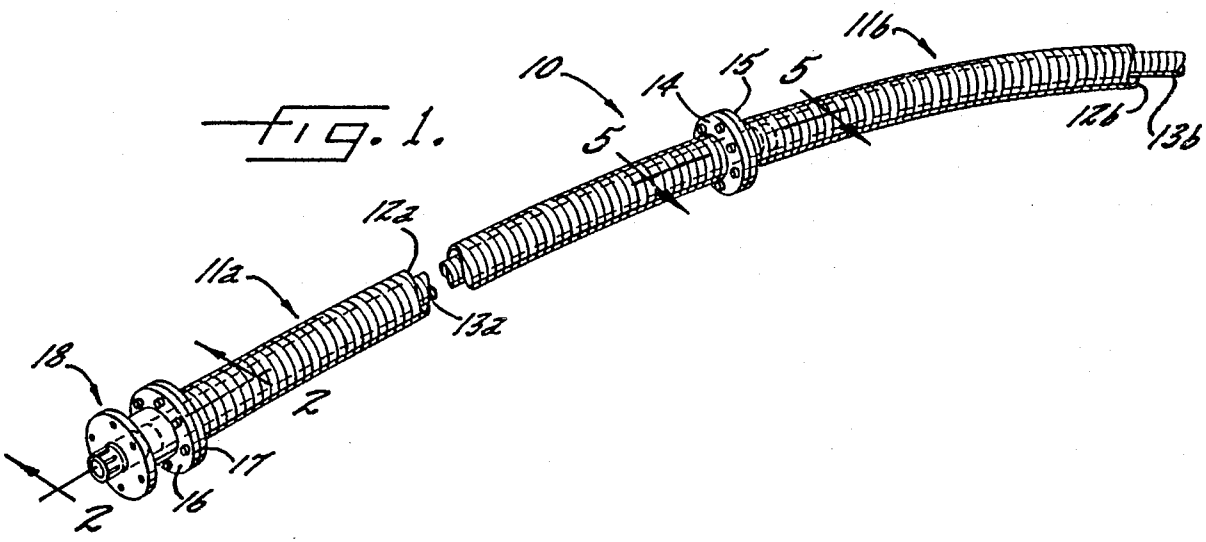
FIG. 1 is a perspective view of a coaxial cable assembly embodying the present invention.

Turning now to the drawings and referring first to FIG. 1, a semi-flexible coaxial cable 10 comprises multiple segments 11*a*, 11*b*, etc. each having an outer conductor 12*a*, 12*b*, etc. and an inner conductor 13*a*, 13*b*, etc. The outer conductors of the multiple segments 11 are connected by multiple pairs of flanges 14 and 15, and the left-hand end of the cable is connected by a similar pair of flanges 16 and 17 to a conventional EIA connector 18. Each pair of connecting flanges 14, 15 and 16, 17 is rigidly connected by a series of bolts passed through holes formed at equal intervals around the flanges and attached thereto by nuts threaded ont the bolts (see FIG. 2).

Each individual cable segment has a length which is convenient for packing and shipping in the form of straight lengths, rather than on reels. For example, thirty-nine-foot lengths are convenient for most applications and can be readily packed in standard shipping containers. The inner and outer conductors 12 and 13 may be packed and shipped separately and assembled in the field, or the inner and outer conductors of each separate segment may be pre-assembled, so that the only field operation required is the joining of the multiple segments.

Figure 5:
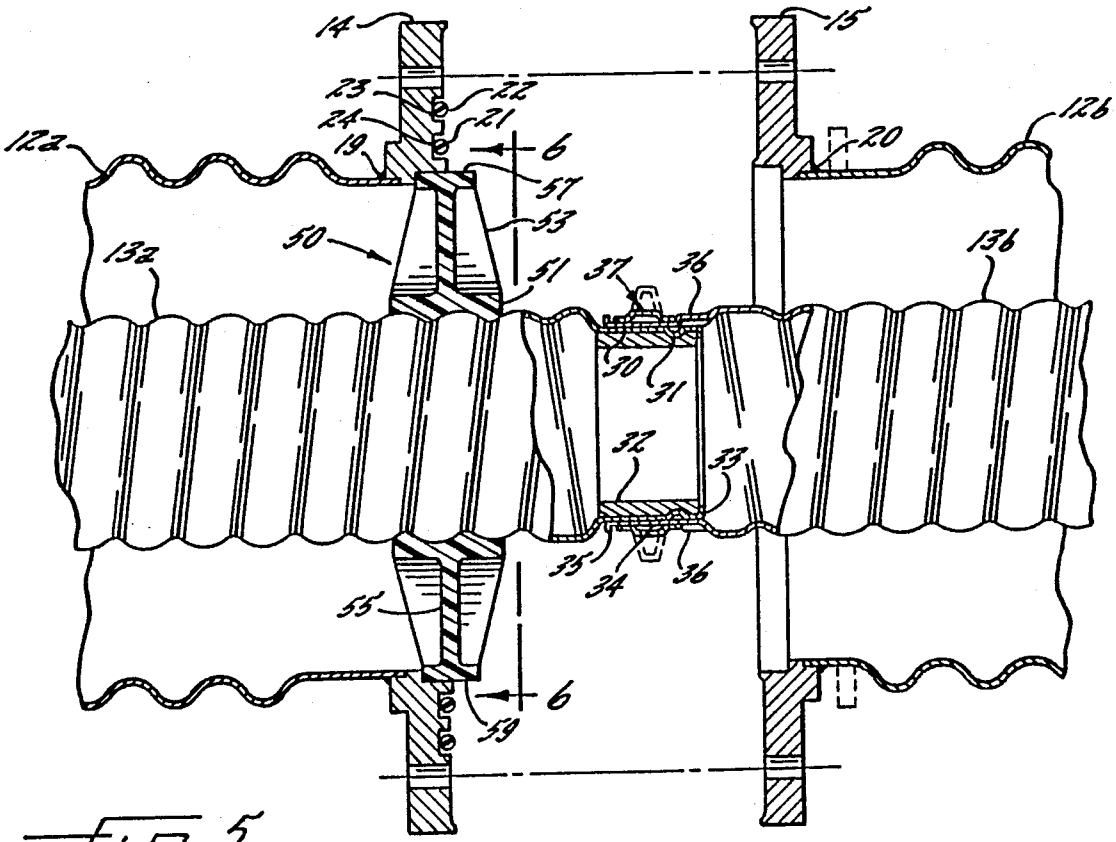
FIG. 5 is an enlarged section taken generally along line 5—5 in FIG. 1.

As can be seen most clearly in FIG. 5, the flanges 14 and 15 used to join adjacent segments are welded to the ends of the outer conductor segments. In the preferred embodiment illustrated in the drawings, each outer conductor segment 12 is corrugated along most of its length, but terminates at each end with a short plain cylindrical section to which one of the flanges 14 or 15 can be easily attached . For example, the flanges can be attached by welding if the outer conductor segments 12 are made of aluminum or by soldering or brazing if the conductor segments are made of copper. The weld seams 19 and 20 preferably extend continuously around the entire circumference of the outer conductors.

In order to provide a gas seal along the mating surfaces of the two flanges 14 and 15, a pair of O rings 21 and 22 is provided in a pair of recesses 23 and 24 formed in one of the two mating surfaces. If desired, only a single O ring may be used. Air dielectric coaxial cables are often pressurized to control the humidity level within the air space between the inner and outer conductors; the gas seal formed by the O rings 21 and 22 prevents pressurized air from leaking out along the interface between the two flanges. As is conventional with flanges of this type, narrow raised lands are provided around both the inner and outer edges of the mating surfaces of the flanges 14 and 15 to ensure reliable electrical contact between the two flanges when they are drawn together.

The pair of flanges 16 and 17 which connect the cable segment 11*a* to the EIA connector 18 are identical to the flanges 14 and 15 just described, except that the flange 16 is welded to a short length of plain cylindrical tubing 25. The other end of this tubing 25 is welded to the flange 26 of the EIA connector 18. The major portion of the EIA connector itself is of conventional design and does not form a part of the present invention.

Because the illustrative cable can be packed and shipped in straight lengths, the corrugations formed in the outer conductor segments need be only deep enough to provide the desired degree of flexibility and strength for any given application. This is particularly advantageous in the case of cables having relatively large diameters, e.g., 8 to 12 inches, because such cables have normally been corrugated to a depth which provides the degree of flexibility needed to wind such cables on reels for shipment. Most applications, however, do not require such deep corrugations for purposes of flexibility an strength, and the excessively deep corrugations degrade the electrical performance of the cable and compromise its mechanical performance. With the segmented cable of the present invention, superior electrical performance can be achieved by corrugating the outer conductor segments only to the extent necessary to provide the requisite degree of flexibility and strength for any given application. Indeed, it is not even necessary to corrugate the outer conductor segments along their full lengths; if desired, clusters of corrugations can be provided at spaced intervals, as required to provide the desired degree of flexibility and strength.

In accordance with one aspect of the present invention, the inner conductors of the successive coaxial cable segments 11*a*, 11*b*, etc. are rigidly joined to each other to prevent relative movement between the inner conductors of adjacent cable segments. Heretofore, connectors for the inner conductors of coaxial transmission lines have typically included sliding members to allow relative axial movement between the connected conductors as they expand and contract with temperature changes. The temperature of such cables and waveguides increases during operation because of the electrical energy passed therethrough, and the temperature of the inner conductor is usually much higher than that of the outer conductor. Allowing relative axial movement between the inner conductor and its connections reduces stresses due to differential thermal expansion and contraction between the inner and outer conductors, but at the expense of wear on the sliding members and eventual repair and replacement problems.

By avoiding sliding movement in the interconnections between adjacent inner conductor segments, the present invention eliminates wear on moving parts, thereby providing a cable having an extended operating life and reduced repair and maintenance problems. In the preferred embodiment illustrated in the drawings, a rigid but detachable connection between each pair of adjacent inner conductor segments is effected by telescoping an end portion of one inner conductor segment over the end portion of the adjacent inner conductor segment, with support sleeve inside the overlapping portions of the conductors, and then fastening a clamp around the outside of the overlapping portions. The clamp is tightened firmly in place by a pair of screws, drawing the overlapping portions of the conductors tightly together against the support sleeve.

Referring specifically to FIG. 5, the inner conductor 13*a* of the left-hand cable segment 11*a* has a plain cylindrical end portion 330 which is swaged into a circumferential groove 31 formed in the outer surface of a support sleeve 32 so as to hold the sleeve captive on the cylindrical end portion 30. The extreme end of the conductor 13*a* is bent inwardly to form a flange 33 which facilitates sliding the two conductors over each other. The adjacent inner conductor 13*b* also has a plain cylindrical end portion 34 which telescopes over the end portion 30 of the conductor 13*a*. Several longitudinal slits are formed in the end portion 34 so that it can be compressed tightly against the underlying end portion 30 of the other conductor. The end of the conductor 13*b* is bent outwardly to form a flange 35 to facilitate sliding end portion 34 over portion 30, and several clamp-locating dimples 36 are formed adjacent the last corrugation of the conductor 13*b*. A clamp 37 is mounted in the region between the flange 35 and the clamp locators 36 for drawing the overlapped portions of the conductors 13*a* and 13*b* tightly against each other and the support sleeve 32.

Figure 2:
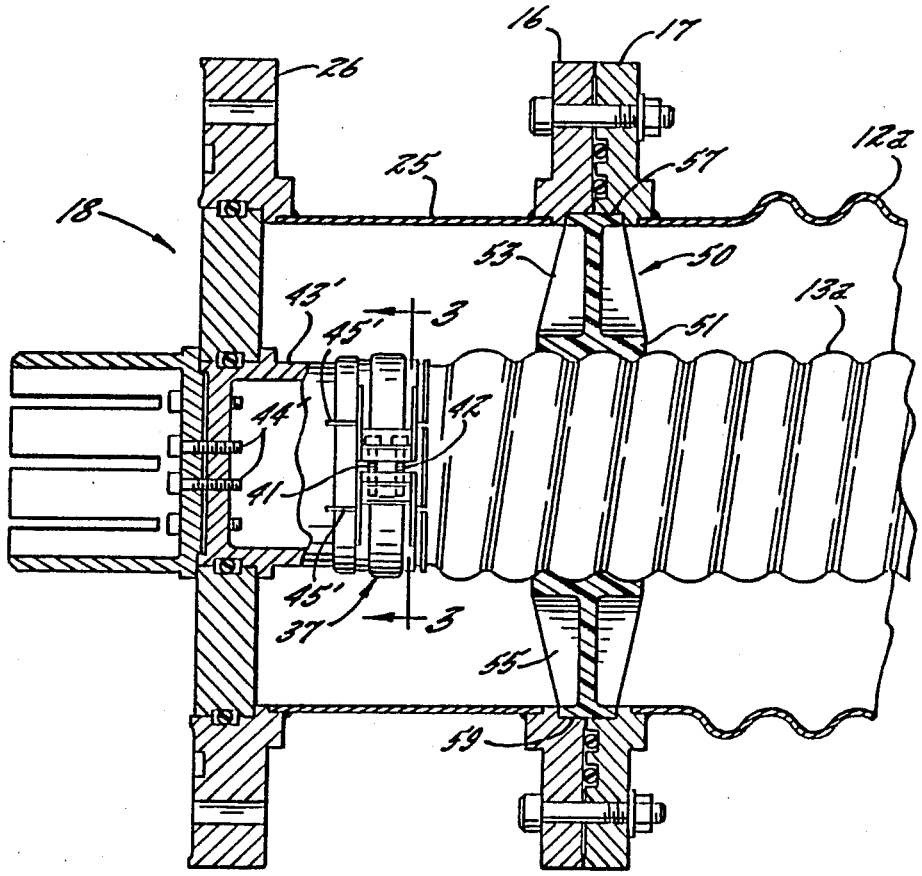
FIG. 2 is an enlarged section taken generally along the line 2—2 in FIG. 1, with only a portion of the inner conductor assembly shown in section.
Figure 3:
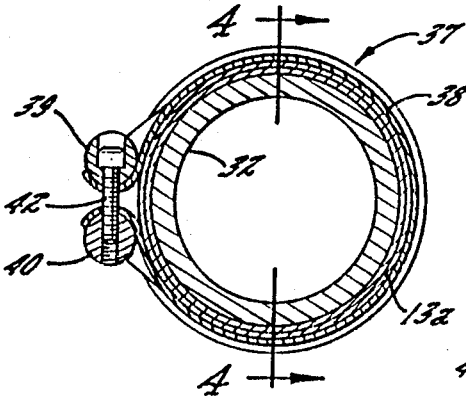
FIG. 3 is an enlarged section taken generally along line 3—3 in FIG. 2.

The clamp 37 is illustrated more clearly in FIGS. 2 and 3. The main body member 38 of the clamp comprises a single stamped or machined piece of metal which extends around the major portion of the circumference of the inner conductors 13*a* and 13*b*. The open ends of the body member 38 are curled outwardly to form recesses for receiving a pair of short cylindrical rods 39 and 40, one of which has two counter-bored holes for receiving the head ends of a pair of screws 41 and 42, and the other of which forms a pair of tapped holes for receiving the threaded shanks of the screws 41 and 42. When the two screws 41 and 42 are tightened, the body member 38 of the clamp is drawn tightly around the overlapping portions of the two inner conductors, thereby clamping them tightly against the inside support sleeve 32. Thus, the two inner conductor segments are rigidly joined to each other, with no sliding fittings.

Figure 4:
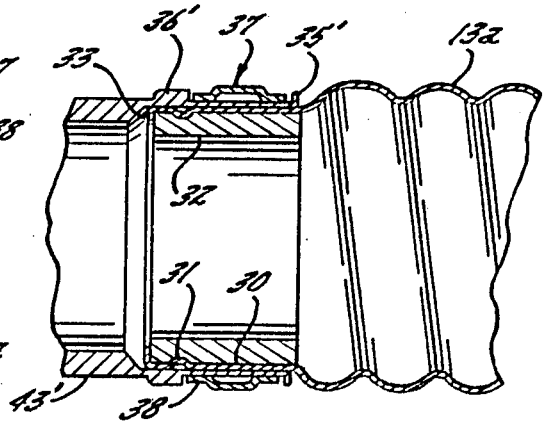
FIG. 4 is a section taken generally along line 4—4 in FIG. 3.

The connection between the inner conductor segment 13*a* and the EIA connector 18 is the same as the connection described for the segment 13*a* and 13*b*, and similar elements in the two connections are identified in the drawings with similar reference numerals, with the addition of a "prime" for the elements in the connection to the EIA connector. The EIA connector 18 is equipped with a special central member 43' which is machined to fit snugly over the plain cylindrical end portion 30, of the inner conductor segment 13*a*. As can be seen in FIG. 2, the central member 43 also has several longitudinal slits 45' to permit it to be compressed tightly against the end portion 30 of the conductor segment 13*a*. As can be seen in FIG. 4, the outer surface of the member 43' forms clamp-locating circumferential beads 35' and 36' to define a recess for receiving the clamp 37'. The base of the central member 43' is fastened to the body of the EIA connector 18 by a plurality of machine screws 44'.

In accordance with a further aspect of the present invention, a plurality of strain insulators is disposed between the inner and outer conductor segments at a common end of each segment, and each of the insulators has means for interlocking the inner and outer conductors segments to establish and maintain a prescribed relationship between the longitudinal positions of the conductors of each segment. Thus, in the illustrative embodiment of FIG. 5, a strain insulator 50 is threaded onto the helically corrugated inner conductor 13*a*. The conductor 13*a* projects axially beyond the end of the corresponding outer conductor 12a so that the joint between the inner conductor segments is offset in the axial direction from the insulator 50. As the insulator 50 is threaded along the inner conductor 13*a*, it eventually abuts the flange 14. The inside corner of the flange 14 is recessed to mate with the corner of the insulator 50, so that the outer edges of the insulator 50 become firmly seated in the flange 14.

Figure 6:
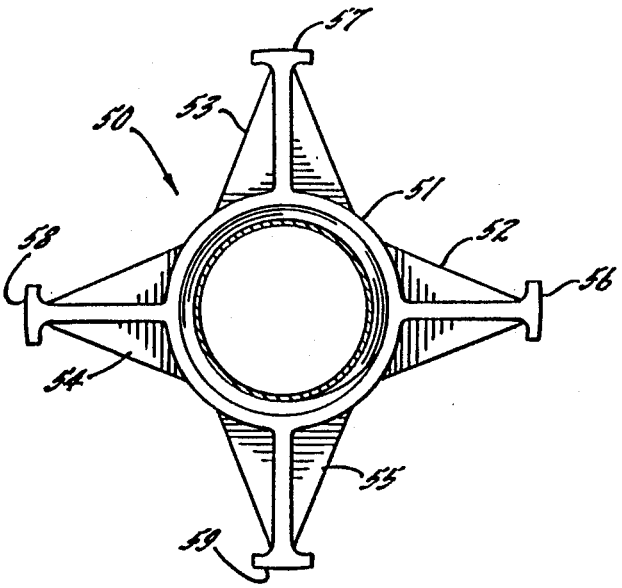
FIG. 6 is a section taken generally along line 6—6 in FIG.

The strain insulator 50 may have a variety of different configurations, but one preferred configuration is illustrated in FIGS. 5 and 6. It can be seen that this particular configuration has a cylindrical hub 51 with a threaded inner surface designed to mate with the corrugations the inner conductor, and four cross-shaped ribs 52, 53, 54 and 55 extending outwardly at 90° intervals around the circumference of the hub. The four ribs 52–55 terminate in four arcuate sections 56, 57, 58 and 59 which are shaped to fit snugly within the recess formed in the inside corner of the flange 14. That recess extends continuously around the entire circumference of the flange so that the insulator 50 can be rotated even after it has been seated within the flange.

After the insulator 50 has been seated in the flange 14, the mating flange 15 welded to the next outer conductor segment 12b is brought into engagement with the flange 14 and detachably fastened thereto by the plurality of bolts and nuts mentioned previously. As can be seen in FIG. 5, the inside corner of the flange 15 is recessed in the same manner as the inside corner of the flange 14 to mate with the outside edge of the insulator 50. Thus, when the two flanges 14 and 15 have been bolted together, the insulator 50 is securely captured between the two flanges. The strain insulator 50 then serves to hold the inner and outer conductors in the desired positions relative to each other, and also to transmit stresses, e.g., due to differential thermal expansion and contraction between the inner and outer conductor segments. In this connection, it should be noted that the ribs 52–55 of the insulator 50 must be strong enough to withstand such stresses.

Locking the corrugated inner conductor to the outer conductor at regular intervals along the length of the cable holds the flexible inner and outer conductors in fixed longitudinal positions relative to each other. This offers several advantages. For example, when the cable is bent the interlocking of the inner and outer conductors substantially prevents the inner conductor from being displaced toward one side of the outer conductor in the bend; for such displacement to occur to any to and significant degree the inner conductor must be free to move longitudinally within the outer conductor, and the interlocking action of the strain insulators effectively prevents such longitudinal movement. The same interlocking action resists relative longitudinal movement between the inner and outer conductors due to external loads on the outer conductor, such as axial forces applied to the outer conductor by the structure used to support the cable assembly.

The combination of the corrugated inner conductor segments and the interlocking of the inner and outer conductors of each cable segment also eliminates the need for any sliding members in the connections between adjacent segments, thereby eliminating the attendant disadvantages of such sliding members. Any stresses produced by differential thermal expansion and contraction between the inner and outer conductor segments are transmitted through the insulators 50 to the flanges 14 and 15, and then on to the supporting structure for the cable assembly. Similarly, any loads applied to only the inner conductor or only the outer conductor are transmitted via the strain insulators to the other conductor.

According to a further important feature of this invention, the strain insulators 50 which interlock the inner and outer conductor segments are also used to controllably pre-stress the inner conductor segments. For example, pre-tensioning the inner conductor segments reduces deformation of the inner conductor segments due to differential thermal expansion of the inner and outer conductors under operating conditions. By continuing to turn the insulator 50 after it has been seated in the flange 14 welded to the outer conductor 12*a*, the insulator 50 can be used to expand the corrugated inner conductor 13*a* in the axial direction, thereby applying a controllable degree of pretensioning to the inner conductor segment. That is, the threaded connection between the insulator 50 and the inner conductor segment 13*a* draws the inner conductor through the insulator, thereby controlling the length of inner conductor that projects beyond the insulator for attachment to the adjacent inner conductor segment 13*b*. Consequently, the insulator 50 permits the projecting end portion of the inner conductor segment 13*a* to be precisely located, while at the same time controlling the tensile load on the inner conductor.

The strain insulators 50 may also be used to pre-compress, rather than pre-tension, the inner conductor segments. This may be accomplished, for example, by rotating the strain insulator in a direction that would cause the insulator to move away from the flange 14 while blocking such movement with the flange 15; the inner conductor segment 13*a* will then be drawn through the insulator in the reverse direction, i.e., shortening the length of inner conductor that projects beyond the insulator and compressing the major length of the inner conductor segment.

As yet another feature of this invention, the inner conductor joints are offset in the axial direction from the insulators by a distance which is only a fraction of a wavelength, preferably less than one-quarter wavelength, and the offset joints are shaped and dimensioned to compensate for the adverse effect of the insulators and joints on the VSWR of the cable assembly Because the insulators 50 have a dielectric constant greater than that of air, the insulators tend to cause an undesirable increase in the VSWR of the cable assembly. To compensate for the effect of the insulators and thus minimize the VSWR increase, air dielectric coaxial cables have typically been provided with inner conductors which are indented at the inner surface of the insulators, and/or with outer conductors which are bulged outwardly at the outer surfaces of the insulators. In the present invention, however, it is preferred to permit the insulators 50 to be positioned a different locations along the length of the inner conductor, so as to permit the inner conductor segments to be pre-tensioned to the desired level and to permit precise positioning of the projecting ends of the inner conductor segments.

Accordingly, the joint between adjacent inner conductor segments is designed to provide a compensating indentation or bulge in the outer surface of the inner conductor, and is located close enough to the insulator (a small fraction of a wavelength) to provide the desired VSWR-compensating effect. The joint can, however, still be located far enough away from the final position of the insulator to provide ready access to the joint, beyond the end of the corresponding outer conductor segment, for initial installation and subsequent repair or replacement. Furthermore, the fact that the VSWR compensation is provided by a rigid structure rather than a structure that includes sliding members renders the VSWR compensation highly stable. The joints between the inner and outer conductor segments can also degrade the VSWR slightly, but this effect can also be compensated by the size and shape of the joints between the inner conductor segments.

By virtue of the axial offset between the connections of the inner and outer conductor segments, the ends of the inner conductor segments are readily accessible for joining successive segments. These joints are also accessible for detaching and rejoining the inner conductor segments, e.g., for repair or replacement. During initial installation, each pair of inner conductor segments is connected before the corresponding pair of outer conductor segments. Then the next outer conductor segment is telescoped over the completed inner conductor joint so that the outer conductor flanges can be bolted together.

Referring particularly to FIG. 5, it can be seen that in this particular embodiment the clamp 37 has a smaller outside diameter (except for the fastening elements on the clamp) than the crests of the corrugations of the main body portions of the inner conductor segments 13*a* and 13*b*. Thus, the joint between the inner conductor segments has a smaller effective diameter than that of the corrugated portions of the inner conductor segments, thereby providing the desired VSWR compensation The effect of this inner conductor joint on the VSWR is determined not only by the outside diameter of the joint assembly, but also by its longitudinal dimension. In coaxial transmission lines, the electric currents flow in the outside surfaces of the inner conductor and the inside surfaces of the outer conductor, and thus it is the outside surface of the joint between the inner conductor segments which primarily determines the effect of the joint on the VSWR of the cable.

The smaller diameter of the inner conductor joints causes the temperature of those particular portions of the inner conductor assembly to increase more than the corrugated portions of the inner conductor during operation. Consequently, a further advantage of the axial offset of the joints from the strain insulators is that heat can be more readily dissipated by radiation and convection from the joints.

As an alternative to the use of indented regions in the inner conductor to compensate for the VSWR degradation caused by the strain insulators and the inner conductor joints, localized outward bulges in the outer conductor segments, as illustrated in broken lines in FIG. 5, can be used to provide the same type of compensation. At least one such bulge should be provided for each strain insulator, preferably offset from the strain insulator by less than a quarter wavelength. Bulges in the outer conductor may require bulges in the inner conductor joints.

Figure 7:
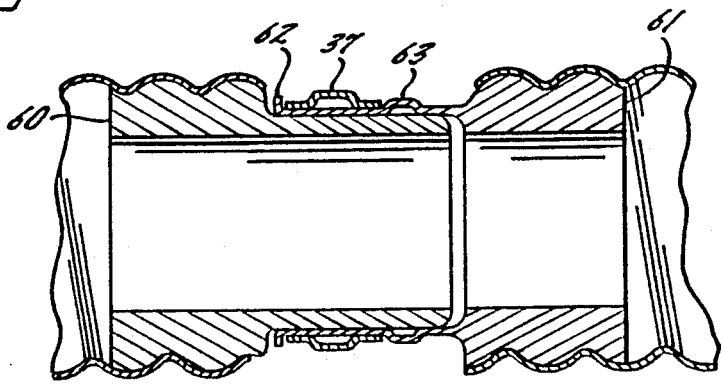
FIG. 7 is a longitudinal section, similar to the central portion of FIG. 5, of a modified embodiment of the invention.
Figure 8:
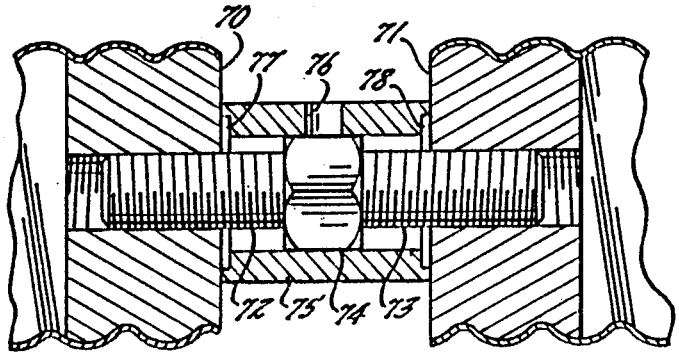
FIG. 8 is a longitudinal section, similar to the central portion of FIG. 5, of another modified embodiment of the invention.

Alternative inner conductor joint assemblies are illustrated in FIGS. 7 and 8. In the particular embodiment illustrated in FIG. 7, two machined connecting elements 60 and 61 are threaded into the inner conductor segments 12*a* and 12*b*, respectively. The male element 60 forms an integral support sleeve 60*a* which extends inside the end portion of the female element 61 and is soldered in place. The end portion of the female connecting element 61, is similar to the end portion of the inner conductor segment 13*b* described above; i.e., a recess for receiving the clamp 37 is formed by an outwardly extending flange 62 and a plurality of clamp-locating dimples 63 spaced around the circumference of the element. When the clamp 37 is tightened, it draws the slit end portion of the female element 61 firmly against the outside surface of the male element 60. This particular connecting arrangement eliminates the need for the swaging operation, because both the connecting elements 60 and 61 are simply threaded and soldered into the respective connectors.

In the modified embodiment illustrated in FIG. 8, a pair of machined brass connecting elements 70 and 71 are again threaded and soldered into the inner conductor segments 12*a* and 12*b*, respectively. In this design, the elements 70 and 71 have threaded bores for receiving oppositely threaded shanks 72 and 73 extending in opposite directions from a central hexagonal head 74. The head 74 is captured inside a sliding sleeve 75 provided with a hole 76 for receiving a tool to rotate the sleeve 75. As the sleeve 75 is rotated, it also rotates the hexagonal head 74 captured therein, thereby threading the two shanks 72 and 73 into the respective connecting elements 70 and 71 and drawing those elements toward each other. To ensure good electrical contact between the sleeve 75 and the brass elements 70 and 71, circumferential recesses 77 and 78 are formed in the inside corners of the ends of the sleeve 75 so that the compressive force is concentrated in a relatively small area on each end of the sleeve 75. This causes the ends of the sleeve 75 to be pressed tightly against the ends of the brass element 70 and 71, around the entire circumference of the sleeve 75.

While the invention has been described thus for with particular reference to the use of segmented inner conductor, this invention is also applicable to a cable assembly which has . continuous corrugated inner conductor and a segmented outer conductor. The continuous inner conductor can be packaged and shipped separately from the outer conductor segments, and can be more readily wound on a reel without excessively deep corrugations because of its smaller diameter. With a continuous inner conductor, the strain insulators are preferably made in two or more pieces which can be fitted onto the inner conductor at the desired location and then fattened together. The strain insulators can still be used to pre-stress the continuous inner conductor.

The corrugations in the inner conductor may also be annular rather than helical. Annular corrugations do not interconnect with each other, i.e., each corrugation forms a closed circle. Consequently, it is preferred to use split strain insulators with annularly corrugated inner conductors, so that the two halves of each insulator can be applied to the inner conductor from opposite sides and then fastened together to clamp them onto the conductor. Such an insulator requires a supplementary device such as a threaded sleeve if adjustable location or pre-stressing is desired.

We claim:

1. A coaxial cable assembly comprising inner and outer conductors, and a plurality of strain insulators disposed between said inner and outer conductors at intervals along the length thereof, each of said insulators and said inner and outer conductors having means for interlocking the inner and outer conductors to resist relative movement between said inner and outer conductors in the longitudinal direction, said strain insulators being adjustable relative to said inner conductors for pre-stressing the inner conductors in the longitudinal direction by positively moving the inner conductor relative to the outer conductor and then holding the inner conductor in the stressed condition.

2. The coaxial cable assembly of claim 1 wherein said strain insulators are adjustable to pre-tension the inner conductor and then hold the inner conductor in the tensioned condition so as to reduce deformation of the inner conductor due to differential thermal expansion of the inner and outer conductors under operating conditions.

3. The coaxial cable assembly of claim 1 wherein said inner conductor is corrugated and said strain insulators are threaded onto the corrugated inner conductor, and which includes means for limiting threading movement of each of said insulators being said inner conductor, whereby continued rotational movement of said insulators about said inner conductor exerts a tensile load on said inner conductor to pretension the inner conductor.

4. The coaxial cable assembly of claim 3 wherein said inner and outer conductors each comprise a plurality of longitudinal segments, each inner conductor segment protrudes in the axial direction beyond one end of the corresponding outer conductor segment, and said limiting means comprises a flange attached to the end of each outer conductor segment, the inner surface of said flange being shaped to receive the outer portion of said insulator as the insulator is advanced longitudinally over said inner conductor and blocking any further advancing movement of said insulator.

5. The coaxial cable assembly of claim 1 wherein said inner and outer conductors each comprise a plurality of longitudinal segments and said inner conductor segments are rigidly joined so that the joined inner conductor segments cannot move relative to each other in the longitudinal direction.

6. The coaxial cable assembly of claim 1 wherein said inner conductor is corrugated.

7. The coaxial cable assembly of claim 1 wherein said inner and outer conductors each comprise a plurality of longitudinal segments, and said inner conductor segments are corrugated.

8. The coaxial cable assembly of claim 7 which includes means for mechanically and electrically joining adjacent inner conductor segments to each other, and means for mechanically and electrically joining adjacent outer conductor segments to each other.

9. The coaxial cable assembly of claim 8 wherein said strain insulators are threaded onto the corrugated inner conductor segments, and said means for joining said outer conductor segments includes means for limiting threading movement of each of said insulators along said inner conductor segments, whereby continued rotational movement of said insulators about said inner conductor segments exerts a tensile load on said inner conductor segments to pre-tension the inner conductor segments.

10. The coaxial cable assembly of claim 1 wherein said inner conductor is a continuous conductor.

11. A coaxial cable assembly comprising a plurality of segments of coaxial cable each having a corrugated inner conductor and a corrugated outer conductor, means for mechanically and electrically joining the inner conductors of adjacent cable segments to each other, means for mechanically and electrically joining the outer conductors of adjacent cable segments to each other, the inner conductors of adjacent cable segments being rigidly joined to each other to prevent relative movement between the inner conductors of said adjacent cable segments, and a plurality of strain insulators disposed between said inner and outer conductors at intervals along the length thereof, each of said insulators and said inner and outer conductors having means for interlocking the inner and outer conductors to establish and maintain a prescribed fixed relationship between the longitudinal positions of the inner and outer conductors of each of said segments, said strain insulator transmitting between said inner and outer conductors longitudinal stresses produced by differential thermal expansion and contraction of said inner and outer conductors so that such differential thermal expansion and contraction is accommodated by equalization of the lengths of said inner and outer conductors between each pair of successive strain insulators along the length of said cable.

12. The coaxial cable assembly of claim 11 wherein said means for joining said inner conductor segments is detachable, each inner conductor segment protrudes in the axial direction beyond one end of the corresponding outer conductor segment to provide ready access to the end of the inner conductor segment for joining it to an adjacent inner conductor segment, and said means joining said outer conductor segments is detachable to permit adjacent outer conductor segments to be detached and moved axially relative to the corresponding inner conductor segments to that the inner conductor joints can be exposed and enclosed by axial movement of the outer conductor segments.

13. A coaxial cable assembly comprising a coaxial cable having an outer conductor and a corrugated inner conductor, at least said outer conductor comprising a plurality of segments, means for mechanically and electrically joining adjacent segments to each other, and a plurality of strain insulators disposed between said inner and outer conductors at intervals along the length thereof, each of said insulators being adjustable relative to said inner conductor in the longitudinal direction, and both said insulators and said inner and outer conductors having cooperating means for interlocking the inner and outer conductors to establish and maintain a prescribed fixed relationship between the longitudinal positions of the inner and outer conductors.

14. A coaxial cable assembly comprising inner and outer conductors, at least said inner conductor comprising multiple segments, means for mechanically and electrically joining adjacent inner conductor segments together, and a plurality of strain insulators disposed between said inner and outer conductors at intervals along the length thereof, said insulators and said inner and outer conductors having means for interlocking the inner and outer conductors to establish and maintain a prescribed relationship between the positions of the inner and outer conductors of each segment, and indentations in the outer surface of said joining means to compensate for the adverse effect of said insulators on the VSWR of the cable assembly, said indentations being offset in the axial direction from said insulators.

15. A method of forming a coaxial cable from an outer conductor and a corrugated inner conductor, said otter conductor comprising a series of longitudinal segments, said method comprising tee steps of mounting a strain insulator on the outer surface of the projecting portion of each inner conductor segment, the inner surface of said insulator meshing with the corrugated outer surface of said inner conductor, joining a pair of outwardly extending flanges to the opposed ends of each successive pair of outer conductor segments, the inner surfaces of said flanges meshing with the outer surfaces of said strain insulators to interlock the inner and outer conductor segments and thereby resist differential thermal expansion and contraction between said inner and outer conductor segments in the longitudinal direction, and rigidly fastening each adjoining pair of said flanges to each other.

16. A method of forming a coaxial cable from an outer conductor and a corrugated inner conductor, said outer conductor comprising a series of longitudinal segments, said method comprising the steps of mounting a strain insulator on the outer surface of each inner conductor segment, the inner surface of said insulator meshing with the corrugated outer surface of said inner conductor, meshing the strain insulator with the corresponding outer conductor segment to interlock the inner and outer conductor segments, and adjusting said strain insulator relative to the inner conductor segment on which the strain insulator is mounted to positively move said inner conductor segment relative to the corresponding outer conductor segment in the longitudinal direction to pre-stress the joined inner conductor segments during the mounting of said strain insulators.

17. A method of manufacturing, shipping and installing a corrugated coaxial cable assembly, said method comprising the steps of forming the outer conductor as a plurality of longitudinal segments and packaging said segments in straight lengths;

forming a corrugated inner conductor and a plurality of strain insulators shaped to mesh with the corrugated outer surface of the inner conductor, telescoping successive segments of the outer conductor over the inner conductor and installing a plurality of strain insulators on the inner conductor at intervals along the length thereof, engaging each strain insulator with an outer conductor segment and then rotating the strain insulator to pre-tension the inner conductor, mechanically and electrically joining adjacent outer conductor segments to each other after they have been telescoped over the inner conductor, and locking the outer periphery of each strain insulator to the assembly of outer conductor segments.

18. A coaxial cable assembly comprising a coaxial cable having an outer conductor and a corrugated inner conductor, and a plurality of strain insulators disposed between said inner and outer conductors each of said strain insulators and said inner and outer conductors having means for interlocking the inner and outer conductors to establish and maintain a prescribed fixed relationship between the longitudinal positions of the inner and outer conductors, said strain insulators being positioned relative to said inner and outer conductors, which are interlocked via said strain insulators, such that said inner conductor is pre-stressed in the longitudinal direction.

19. A coaxial cable assembly comprising inner and outer conductors, at least said inner conductor comprising multiple segments, means for mechanically and electrically joining adjacent inner conductor segments together, and a plurality of strain insulators disposed between said inner and outer conductors at intervals along the length thereof, said insulators and said inner and outer conductors having means for interlocking the inner and outer conductors to establish and maintain a prescribed relationship between the positions of the inner and outer conductors of each segment, and bulges in the outer surface of said joining means to compensate for the adverse effect of said insulators on the VSWR of the cable assembly, said bulges being offset in the axial direction from said insulators.

20. A coaxial cable assembly comprising the inner and outer conductors, said inner and outer conductors comprising a plurality of longitudinal segments, means for mechanically and electrically joining adjacent inner conductor segments to each other, and means for mechanically and electrically joining adjacent outer conductor segments to each other, and a plurality of strain insulators disposed between said inner and outer conductors at interval along the length thereof, said insulators and said inner and outer conductors having means for interlocking the inner and outer conductors to establish and maintain a prescribed relationship between the positions of the inner and outer conductors of each segment, and bulges in said outer conductor segments to compensate for the adverse effect of said insulators on the VSWR of the cable assembly, at least one of said bulges being associated with each of said strain insulators and longitudinally offset from the strain insulator.

* * * * *